US005235907A

United States Patent [19]

Hirata

[11] Patent Number: 5,235,907

[45] Date of Patent: Aug. 17, 1993

[54] APPARATUS FOR STACKING PRINTED SHEETS FOR A SCREEN PROCESS PRINTING MACHINE

[75] Inventor: Nobuharu Hirata, Koto, Japan

[73] Assignee: Sakurai Graphics Systems Corporation, Tokyo, Japan

[21] Appl. No.: 986,288

[22] Filed: Dec. 7, 1992

[30] Foreign Application Priority Data

Jun. 12, 1992 [JP] Japan ..... 4-40429[U]

[51] Int. Cl.[5] ..... B41L 13/00

[52] U.S. Cl. ..... 101/118; 101/240; 271/3.1; 271/227; 271/244; 271/265; 271/154; 271/155

[58] Field of Search ..... 101/118, 117, 232, 236, 101/237, 238, 239, 240, 241, 474, 480, 424.1; 271/3.1, 227, 244, 246, 265, 152, 153, 154, 155

[56] References Cited

U.S. PATENT DOCUMENTS 2,195,545 4/1940 Stobb ..... 101/240
3,652,083 3/1972 Bosshardt ..... 101/232
4,181,078 1/1980 Davis ..... 101/240
4,811,939 3/1989 Keith ..... 271/155
4,971,311 11/1990 Tsukimoto ..... 271/227
5,116,037 5/1992 Gerlier et al. ..... 271/3.1

*Primary Examiner*—Eugene H. Eickholt
*Attorney, Agent, or Firm*—Heller, Ehrman, White & McAuliffe

[57] ABSTRACT

A printing machine system includes a printing machine which discharges a printed material after the printing operation is completed. The printing machine system also includes a drier which dries the printed material discharged from the printing machine. A stacker is disposed intermediate the printing machine and the drier. The stacker includes a frame, and a storage for storing the printed materials discharged from the drier. A transfer apparatus is disposed in the proximity of the upper portion of the stacker, for conveying the printed materials discharged from the printing machine to the drier one by one.

13 Claims, 6 Drawing Sheets

APPARATUS FOR STACKING PRINTED SHEETS FOR A SCREEN PROCESS PRINTING MACHINE

BACKGROUND OF THE INVENTION

1. Field of the Invention

The present invention relates generally to an apparatus for stacking printed sheets from a screen process printing machine system. More particularly, the apparatus for stacking printed sheets is disposed between the printing machine and a drier of the screen process printing machine system, and conveys the printed sheets into the drier, and thereafter into storage.

2. Description of the Related Art

In a conventional screen process printing machine system, as shown in FIG. 9, a first conveyor 92 is disposed between a screen process printing machine 90 and a wicket drier 91. A second conveyor 94 which is fixedly inclined by a predetermined angle and a case 95 for storing printed sheets are disposed below the first conveyor 92. The printed sheets discharged from the printing machine 90 are fed into the wicket drier 91, via the first conveyor 92 one by one. Each of the printed sheets is dried within the wicket drier 91, and is conveyed into the case 95, via the second conveyor 94. The dried printed sheets are stacked in the case 95. When the case 95 if filled up, an operator removes the stacked sheets from the case 95, and then straightens the edges of the stacked sheets.

However, in conventional systems, the second conveyor 94 and the case 95 are integrally connected. The first conveyor 92 and the case 95 are separate. When it is desired to stack a large quantity of sheets by increasing the capacity of the case 95, the size of the first conveyor 92 needs to be increased accordingly. As a result, a wide space is required between the printing machine and the drier, for installing the first conveyor 92 and the case 95. On the other hand, when the size of the first conveyor 92 is reduced in order to decrease the space between both the machines, the size of the case 95 is also reduced. Therefore, the ability for stacking the discharged sheets is decreased.

Further the operator should straighten the edges of the stacked sheets in the case 95. The operation of straightening the edges is rather difficult to perform properly. Furthermore, the dried sheets are continuously discharged into the case 95 until the printing machine and the drier stop operating, even when the sheets are stacked in the case 95 beyond its storage capacity. Therefore, the operator must watch out for an overfill of the case 95.

SUMMARY OF THE INVENTION

Accordingly, it is a primary object of the present invention to provide a screen process printing machine system which requires a rather small installation space, which is achieved by reducing the space between a printing machine and a drier, and to provide an apparatus which has an improved ability for stacking the printed sheets.

To achieve the foregoing and other objects and in accordance with the purpose of the present invention, a screen process printing machine system includes a printing machine which prints on a sheet and which discharges the printed sheet. Further, the screen process printing machine system includes a drier which dries the printed sheets discharged from the printing machine. A stacker apparatus is arranged between the printing machine and the drier. The stacker apparatus includes a frame. The frame includes a storage apparatus which stores the printed sheets discharged from the drier. A transfer apparatus, conveys the printed sheets discharged from the printing machine to the drier one by one.

BRIEF DESCRIPTION OF THE DRAWINGS

The features of the present invention that are believed to be novel are set forth with particularity in the appended claims. The invention, together with the objects and advantages thereof, may best be understood by reference to the following description of the preferred embodiments together with the accompanying drawings in which:

DETAILED DESCRIPTION OF THE PREFERRED EMBODIMENT

A preferred embodiment of a screen process printing machine system according to the present invention will now be described referring to FIGS. 1 through 8.

Figure 8:
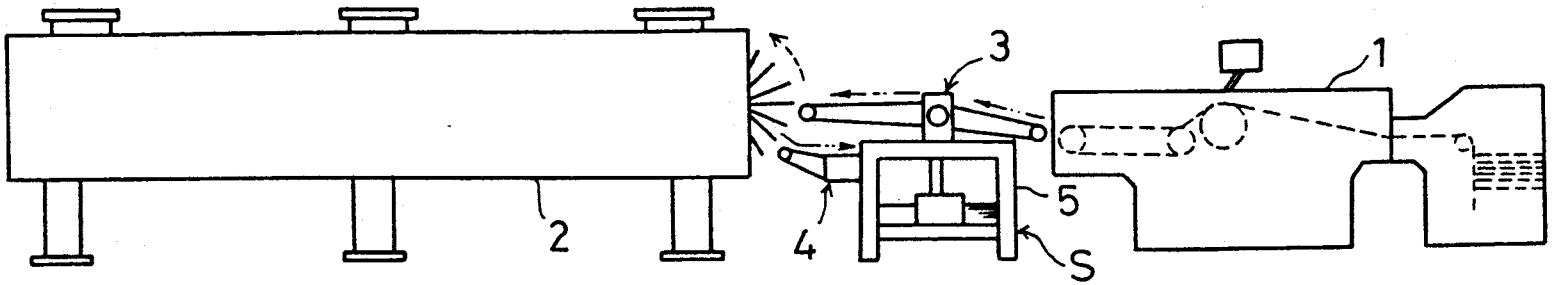
FIG. 8 is a schematic view of the screen process printing machine system including the stacker apparatus of FIG. 1.
Figure 9:
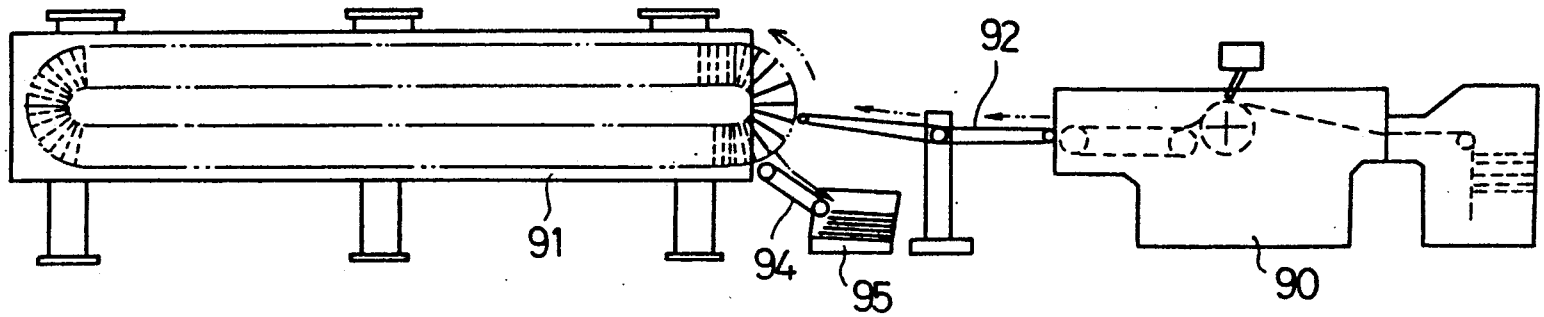
Fig. 9 (Prior Art)
FIG. 9 is a schematic view of a conventional screen process printing machine system including the stacker apparatus.

As illustrated in FIG. 8, a screen process printing machine 1 and a wicket drier 2 are installed at a predetermined distance from each other. A stacker S is disposed midway between the printing machine 1 and the drier 2. Hereinafter, the portion of the stacker S which is closer to the drier 2 will be referred to as the front portion. Similarly, the portion of the stacker S closer to the printing machine 1 will be referred to the rear portion. A first transfer apparatus 3, which transfers the printed sheets discharged from the printing machine 1 into the drier 2 one by one, is disposed at the upper portion of the stacker S. A second transfer apparatus 4, which transfers the dried printed sheets discharged from the drier 2 into the stacker S, is disposed at the front portion of the stacker S.

Figure 2:
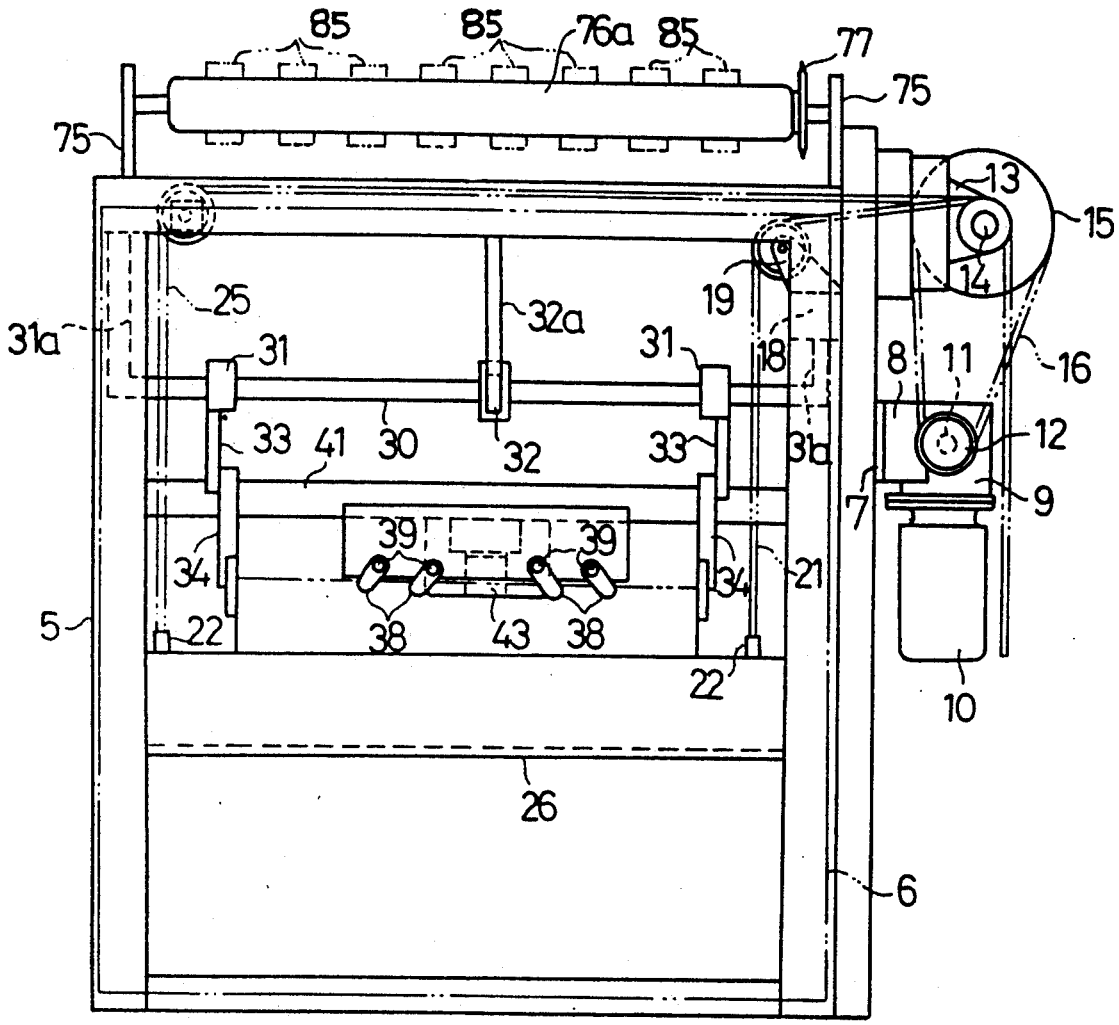
FIG. 2 is a rear view of the stacker apparatus of FIG. 1.
Figure 3:
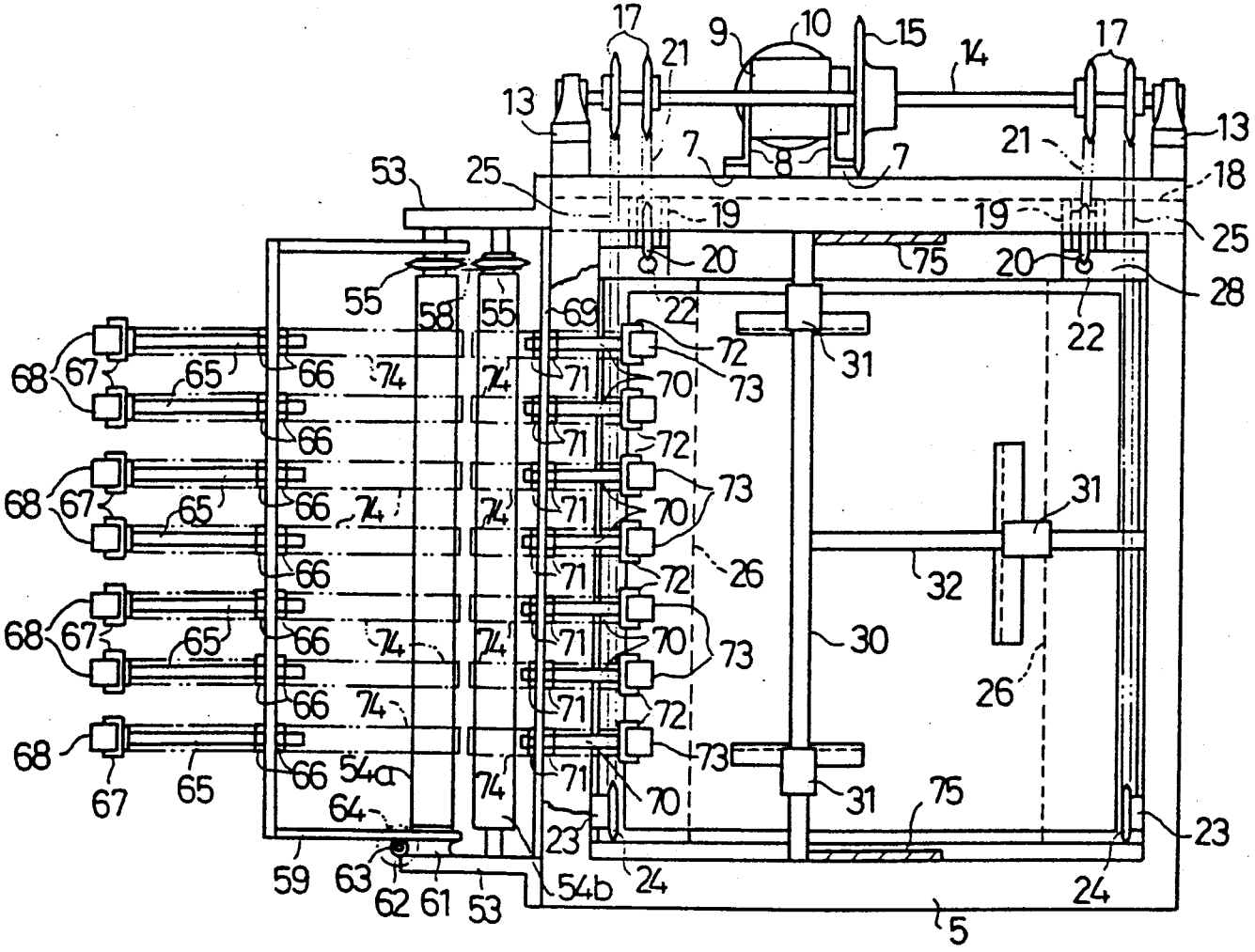
FIG. 3 is a plan view showing the stacker apparatus of FIG. 1, with a first conveyor omitted.

The stacker S will now be described referring to FIGS. 1 through 3. Since FIG. 2 is a rear view of the stacker S, the right side of the stacker S is shown to the left of the figure, while the left side is shown to the right. In FIG. 3, the first transfer apparatus 3 of the stacker S is omitted. A frame 5 of the stacker S has a generally rectangular shape. As illustrated in FIG. 2, the rear portion of the stacker S is enclosed by a cover 6. A mounting bar 7 is secured to the left side of the frame 5 (the right side of FIG. 2). A gear box 9 is secured midway along the mounting bar 7, in the longitudinal direction, via a pair of stays 8. A lift motor 10 is secured underneath the gear box 9. A drive shaft 11, which extends backwardly, is rotatably disposed at one side of the gear box 9. A drive sprocket wheel 12 is secured at the distal end of the drive shaft 11.

As illustrated in FIG. 3, a pair of bearings 13 are secured at the upper ends of the left portion of the frame 5. A drive shaft 14 is rotatably supported between bearings 13. A driven sprocket wheel 15, which has a larger diameter than that of the drive sprocket wheel 12, is secured midway along the driven shaft 14 in the longitudinal direction thereof. An endless chain 16 is installed between the driven sprocket wheel 15 and the drive sprocket wheel 12. Each end of the drive shaft 14 has a pair of first lifting sprockets 17, an inner sprocket and an outer sprocket.

As illustrated in FIGS. 2 and 3, a support bar 18, which extends in the front and rear directions with respect to the frame 5, is secured on the upper left side of the frame 5. Each end of the support bar 18 has a pair of bearing plates 19, which are secured on the upper portion of the corresponding ends. A pair of second lifting sprockets 20 are rotatably supported between each pair of the bearing plates 19. Each one of the inner lifting chains 21 is installed between the inner sprocket of the first lifting sprocket 17, and the second lifting sprocket 20. Both ends of the inner lifting chains 21 extend downwardly on both sides of the frame 5.

A pair of bearing metals 23 are secured on the upper ends to the right side of the frame 5. A third lifting sprocket 24 is rotatably supported in each of the bearing metals 23. An outer lifter chain 25 is installed between each of the third lifting sprockets 24 and the outer sprocket of the first lifting sprocket 17. Both ends of the outer lifting chains 25 are extended downwardly on both sides of the frame 5. A guide plate, not shown, is provided in the first lifting sprocket 17, for preventing the inner and outer lifting chains 21 and 25 from becoming disengaged from the first sprocket 17.

Figure 1:
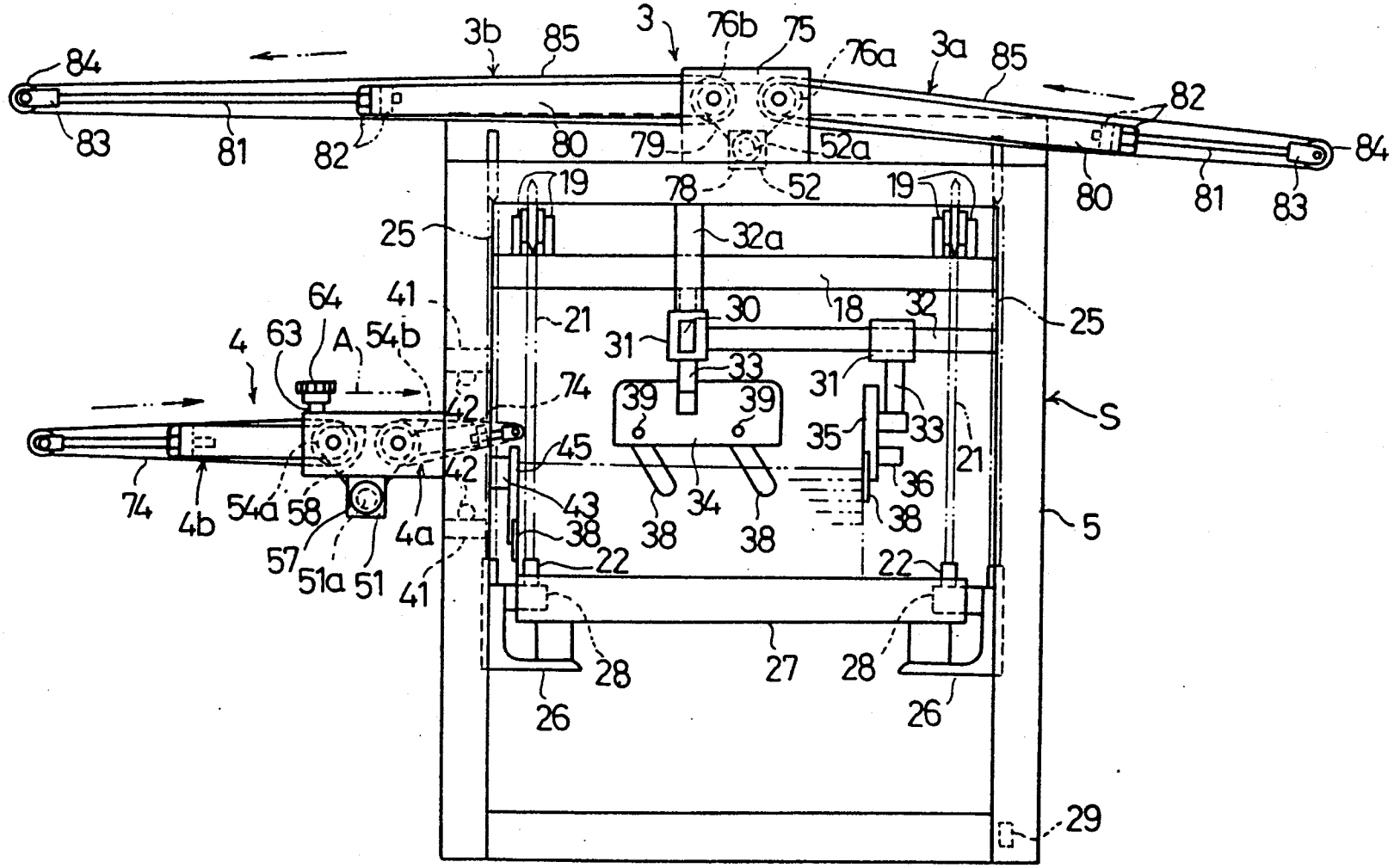
FIG. 1 is a side view of a stacker apparatus in accordance with the present invention.

As illustrated in FIGS. 1 and 3, a pair of lift bars 26 are disposed within the frame 5, and face each other. Each of the lift bars 26 is vertically movable therein. Each of the lift bars 26 is extended horizontally, and has a generally L cross-section. A pallet 27 on which the discharged sheet from the drier 2 is transferred, is detachably secured to the lift bars 26. A fixture 28 which extends horizontally, is secured to the right and left edges of the inner peripheral surface of each lift bars 26. Each pair of connectors 22, which projects upwardly disposed on the upper portion of the fixture 28 at the corresponding ends. Each inner end of the chains 21 and 25 is connected to both ends of the pair of lift bars 26, via the connectors 22.

Therefore, as the lift motor 10 is activated, the pallet 27 is caused to shift vertically, via the inner and outer lifting chains 21 and 25 and the lift bars 26. A microswitch 29, which is activated by making a contact with the bottom surface of one of the lift bars 26 when they are lowered, is disposed in the bottom portion of the frame 5.

As illustrated in FIG. 2, a first guide rail 30 is horizontally disposed at the middle portion of the frame 5 in the front and rear directions. The left distal end of the first guide rail 30 is connected to the bottom surface of the support bar 18, via a connecting rod 31*a* which is extending upwardly, as illustrated in FIG. 2. On the other hand, the right distal end of the first guide rail 30 is directly connected to the bottom surface of the frame 5. A pair of sliders 31, which are slidably movable along the longitudinal direction, are provided on the first guide rail 30. A second guide rail 32, which is extended in the rear direction, is connected to the inner surface of the first guide rail 30, at the middle portion of the guide rail 30 along the longitudinal direction. The rear distal end of the second guide rail 32 is connected to the bottom surface of the frame 5, via a connecting rod 32*a* which extends upwardly. A slider 31, which is slidably movable along the longitudinal direction, is provided on the second guide rail 32.

The upper section of each sheet guide 34 is securely connected to the lower portion of the corresponding sliders 31 disposed on the first guide rail 30, via a corresponding connector 33. As illustrated in FIG. 1, the upper portion of a sheet guide 35 is securely connected to the lower portion of the slider 31, which is disposed on the second guide rail 32, via the connector 33. The sheet guides 34 and 35 have generally rectangular shapes. The sheet guide 35 has longer horizontal edges than those of the sheet guide 34. An upper limit sensor 36 is secured at the central portion of the exterior surface of the sheet guide 35. The upper limit sensor 36 is a reflection type photo sensor. The upper limit sensor 36 detects the upper limit of the stacked sheets by emitting a light toward the uppermost surface of the stacked discharged sheets stored in the pallet 27 and receiving the reflected light from the uppermost surface.

Figure 4:
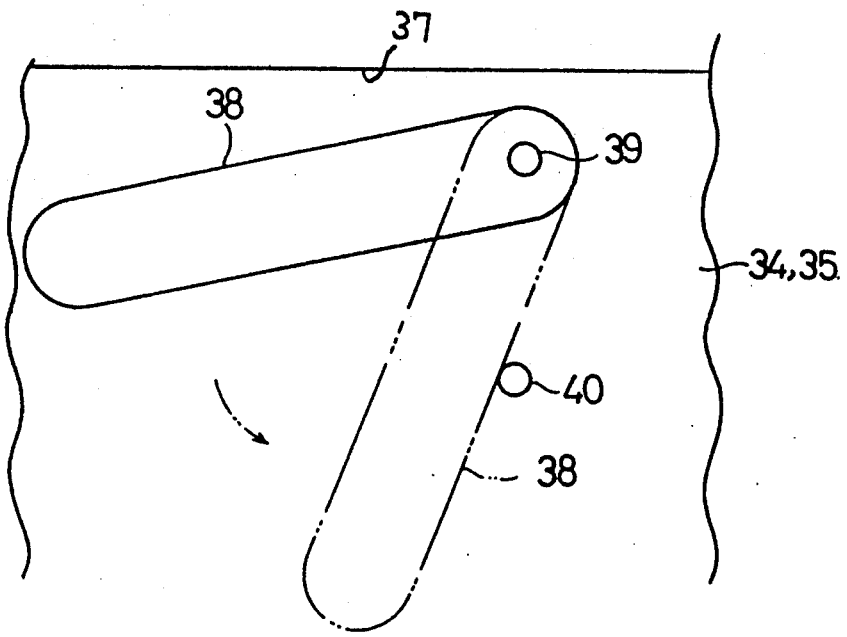
FIG. 4 is an enlarged front view showing a guide plate used in the stacker apparatus of FIG. 1.
Figure 5:
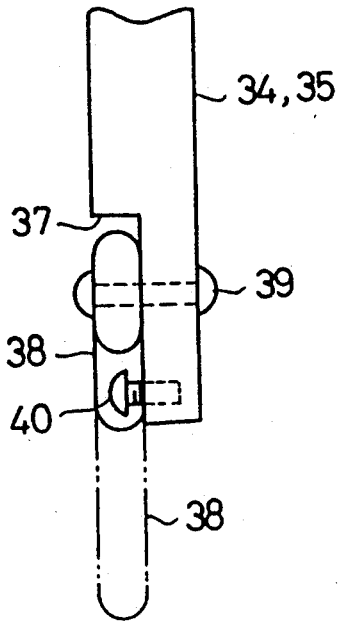
FIG. 5 is an enlarged side view showing the guide plate of FIG. 4.

As illustrated in FIGS. 4 and 5, a step 37 is formed at the lower portion of the inner surfaces of the sheet guides 34 and 35. A plurality of guides 38, are lined up in a row, are provided in the step 37. Each one of the guides 38 is pivotally supported by a corresponding pin 39. Each one of the sheet guides 34 and 35 has a protruded stopper 40 fitted below the corresponding pin 39, for limiting the downward movement of the corresponding guide 38. Each guide 38 is caused to swing based on its engagement with the pallet 27, when the pallet 27 is caused to move vertically.

As illustrated in FIG. 1, a pair of mounting bars 41 are disposed at the front portion of the frame 5, and extend horizontally, in parallel, with respect to the transport passage (in the direction shown by the arrow A) for detecting the discharged sheets from the drier 2, where the transport passage is located between the pair of the bars 41. A photoelectric sensor 42, which detects the leading edge of the discharged sheet when the discharged sheet is conveyed into the frame 5, is securely provided in the opposing surfaces of the mounting bars 41.

Figure 6:
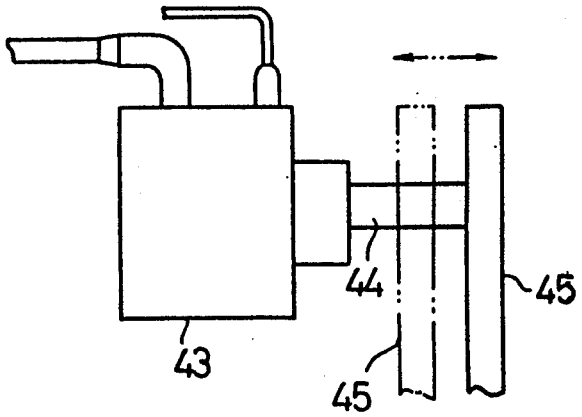
FIG. 6 is an enlarged side view showing a front end sheet guide plate secured on an air cylinder used in the stacker apparatus of FIG. 1.

As illustrated in FIGS. 1 and 2, an air cylinder 43 is arranged at the front portion of the frame 5. As illustrated in FIG. 6, the air cylinder 43 includes a rod 44 which is horizontally movable. A sheet guide plate 45 is secured to the rod 44. The sheet guide plate 45 is reciprocally movable between the following two positions: the first position where the front edges of the stacked sheets on the pallet 27 are straightened; and the second or waiting position where the plate 45 is retracted from the position of the edges being straightened, based on the movement of the rod 44 of the air cylinder 43. The sheet guide plate 45 is usually located at the position where the edges of the stacked sheets are straightened. When the photoelectric sensor 42 detects the sheet being discharged, the sheet guide plate 45 is caused to shift into its waiting position. As illustrated in FIG. 2, a plurality of guides 38, which have the same configurations as the sheet guides 34 and 35, are disposed in a row, under the sheet guide plate 45.

The second transfer apparatus 4 will now be described referring to FIGS. 1 and 3, prior to the description of the first transfer apparatus 3.

The second transfer apparatus 4 includes a first conveyor 4*a* which is disposed at the side of the pallet 27, and a second conveyor 4*b* which is disposed at the side of the drier 2. The second conveyor 4*b* conveys the sheet discharged from the drier 2 to the vicinity of the edge of the frame 5. The first conveyor 4*a* conveys that sheet into the pallet 27 which disposed within the frame 5.

As illustrated in FIG. 3, a pair of arms 53 are secured at both front ends of the frame 5. Drive rollers 54*a* and 54*b*, which are extended in the right and left directions are rotatably supported at the upper portion of the arms 53. A driven sprocket 55 is secured at the left end of each drive roller 54*a* and 54*b*. As illustrated in FIG. 1, a transfer motor 51 is disposed below the left arm 53. The transfer motor 51 has a drive shaft 51*a* which protrudes rightwardly. A drive sprocket 57 is secured to the drive shaft 51*a*. A transfer chain 58 is installed between the driven sprocket 55 and the drive sprocket 57.

A support frame 59 has a generally U-shaped form, is rotatably supported at both distal ends of the drive roller 54*a*. A plurality of threaded bores (not shown), which are penetrated through the support frame 59 in the front and rear directions, are formed in the support frame 59. Each of the threaded bores has an adjustor rod 65. Each adjustor rod 65 is secured to the support frame 59 by means of a pair of nuts 66. A bearing metal 67, which has a generally U-shaped form, is secured to the front end of each adjustor rod 65. Each bearing metal 67 rotatably supports a tension roller 68. Further, a timing belt 74 is installed between each one of the tension rollers 68 and the drive roller 54*a*. The second conveyor 4*b* of the second transfer apparatus 4 includes the timing belts 74.

A worm wheel 61 is coaxially secured to the arm 53, with respect to the drive roller 54*a*, between the right end of the support frame 59 and the right arm 53. A worm 62 is rotatably supported by the arm 53, and engages the worm wheel 61. A rotary shaft 63 protrudes upwardly, and is connected to the upper portion of the worm 62. A handle 64 is secured to the upper end of the rotary shaft 63. As the inclination of the support frame 59 is adjusted in the incline and decline directions, the inclination of the entire second conveyor 4*b* is therefore adjusted by turning the handle 64 in the forward or reverse directions.

The first conveyor 4*a* of the second transfer apparatus 4 will now be described.

A support plate 69 is secured between the proximal ends of the pair arms 53. A plurality of threaded holes (not shown), which penetrate through the support plate 69 in the front and rear directions, are formed in the support plate 69. Each threaded hole has an adjustor rod 70 which takes a position corresponding to the protruded line of the adjustor rod 65. Each adjustor rod 70 is secured to the support plate 69 by means of a pair of nuts 71. A bearing metal 72, which has a generally U-shaped form, is secured to the rear end of each adjustor rod 70. Each bearing metal 72 rotatably supports a tension roller 73. Further, a timing belt 74 is installed between each one of the tension rollers 73 and the drive roller 54*b*. The first conveyor 4*a* of the second transfer apparatus 4 includes those timing belts 74. Therefore, the tension of each timing belt 74 is adjusted by adjusting the position of the adjustor rods 65 and 70 in the front and rear directions.

The first transfer apparatus 3 will now be described referring to FIGS. 1 and 2. The first transfer apparatus 3 includes a first conveyor 3*a* which is disposed at the side of the screen process printing machine 1, and a second conveyor 3*b* which is disposed at the side of the drier 2. The first conveyor 3*a* conveys the discharged sheet from the printing machine 1 to the upper central portion of the frame 5. The second conveyor 3*b* conveys that sheet from the upper central portion of the frame 5 into the drier 2.

At the upper central portion of the frame 5, a pair of bearing plates 75 are secured at both the right and left ends of the frame 5. A pair of drive rollers 76*a* and 76*b*, which are extended in the right and left directions, are rotatably supported in the upper portion of the bearing plates 75. Each one of the drive rollers 76*a* and 76*b* has a driven sprocket 77 (only one for the drive roller 76*a* is shown) at the corresponding left end thereof.

A feed motor 52 is secured to the lower side of the bearing plate 75 which is disposed at the left end of the frame 5. The feed motor 52 has a drive shaft 52*a* which protrudes rightwardly. A drive sprocket 78 is secured to the drive shaft 52*a*. A chain 79 is installed between the drive sprocket 78 and the driven sprocket 77. Both drive rollers 76*a* and 76*b* are caused to rotate in the same direction, via the drive sprocket 78, the driven sprocket 77 and the chain 79, when the feed motor is activated.

A support frame 80, which has a generally U-shaped form and protrudes toward the printing machine side, is supported by their ends at both ends of the drive roller 76*a*, and are disposed at the rear side. A plurality of threaded bores (not shown), which penetrate through the support frame 80 in the front and rear directions, are formed in the support frame 80. Each threaded bore has an adjustor bar 81. Each adjustor bar 81 is secured to the frame 80 by means of a pair of nuts 82.

A bearing metal 83, which has a generally U-shaped form, is secured to the front end of each adjustor bar 81. Each one of tension rollers 84 is rotatably supported by a corresponding bearing metal 83. A plurality of timing belts 85 are installed between each one of the corresponding tension rollers 84 and the drive roller 76*a*. The first conveyor 3*a* includes the timing belts 85. The tension of each timing belt 85 is adjusted by adjusting the position of the corresponding adjustor bar 81 in the front and rear directions. Further, the second conveyor 3*b* is disposed at the front portion of the drive roller 76*b* in a direction opposite to the first conveyor 3*a*. The second conveyor 3*b* has a similar design to the first conveyor 3*a*. Therefore, the parts in the second conveyor 3*b* are marked with the same corresponding reference numbers of the first conveyor 3*a*. When the drive rollers 76*a* and 76*b* are caused to rotate, each timing belt 85 is caused to rotate synchronously with respect to the rollers 76*a* and 76*b*.

A control unit for the stacker apparatus S will now be described.

Figure 7:
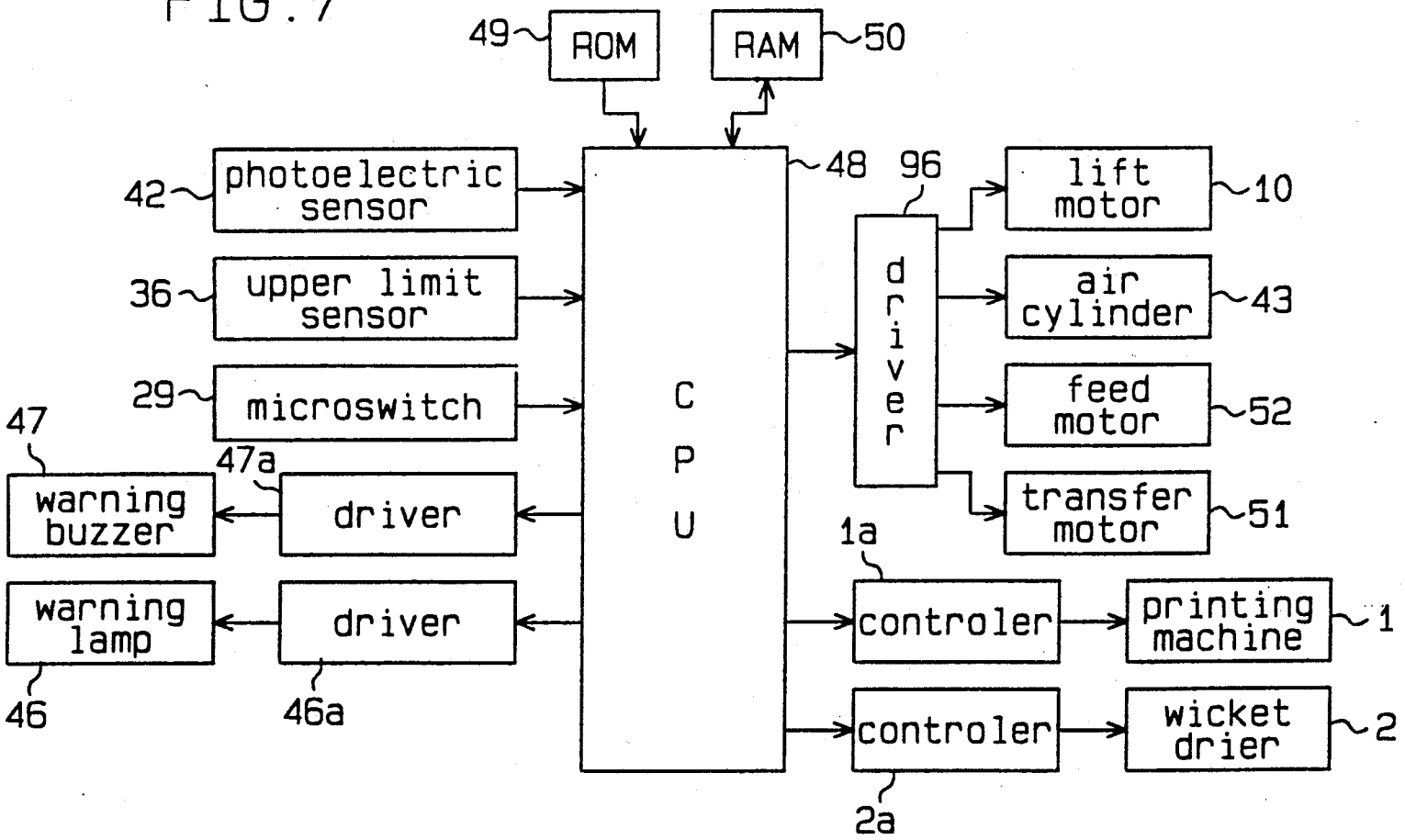
FIG. 7 is a block diagram of the stacker apparatus of FIG. 1.

As illustrated in FIG. 7, the photoelectric sensor 42, the upper limit sensor 36 and the microswitch 29 are electrically connected to a central processing unit (refer to CPU hereinafter) 48. A warning buzzer 46 and a warning lamp 47 are connected to the CPU 48, via drivers 46*a* and 47*a*, respectively. The CPU 48 includes read only memory 49 (hereinafter referred to as ROM)

for storing the program which controls the entire operation of the stacker apparatus S. The CPU 48 also includes random access memory 50 (hereinafter referred to as RAM) which is capable of storing and erasing the required data. A controller for the stacker apparatus is constructed by the CPU 48, ROM 49 and RAM 50.

The lift motor 10, air cylinder 43, transfer motor 51 and feed motor 52 are electrically connected to the CPU 48, via a driver 96. When the upper limit sensor 36 detects the upper limit of the stacked sheets in the pallet 27, the sensor 36 transmits the detected signal to the CPU 48. The CPU 48 transmits a control signal to the lift motor 10, based on the detected signal, to be activated by a preprogrammed amount. As a result, the pallet 27 is lowered.

When the photoelectric sensor 42 detects the leading edge of the discharged sheet from the drier 2, the sensor 42 transmits the detected signal to the CPU 48. The CPU 48 transmits a control signal to the air cylinder 43, based on the detected signal, to control its activation. Therefore, the sheet guide plate 45 is caused to shift into the waiting position.

After a predetermined period of time after the sheet guide plate 45 was shifted, the sheet guide plate 45 is caused to return to the position where the edges of the sheets will be straightened, by the action of the air cylinder 43. Further, when the microswitch 29 is activated, the CPU 48 sends emergency stop signals to the lift motor 10, air cylinder 43, transfer motor 51 and feed motor 52 to stop their operations, in response to the microswitch activation. Furthermore, the CPU 48 activates the warning buzzer 46 and energizes the warning lamp 47, via the drivers **46*a* and 47*a*** respectively.

The operations of the stacker apparatus will now be described.

Prior to the printing operation, the sliders 31, which are disposed in the first guide rail 30 and the second guide rail 32, should be adjusted to match the length and width of the sheets to be printed. Each slider 31 is secured by a corresponding lockbolt (not shown) which is fastened to the corresponding guide rail.

Under this condition, as a power switch (not shown) for the control unit is activated, the CPU 48 activates the feed motor 52. Consequently, the drive rollers **76*a* and 76*b* of the first and second conveyors 3*a* and 3*b* respectively are caused to rotate via the chain 79. Each upper portion of the timing belts 85 of the conveyors 3*a* and 3*b* is shifted toward the drier 2 in the direction shown by the arrow in FIG. 1. The CPU 48 drives the transfer motor 51 to rotate in a predetermined direction. The upper portion of the timing belt 74 is shifted toward the pallet 27, in the direction shown by the arrow in FIG. 1, via drive rollers 54*a* and 54*b* of the first and second conveyors 4*a* and 4*b***, respectively.

Therefore, the printed sheet discharged from the printing machine 1 is placed on the timing belt 85, and is then delivered to the drier 2, by turning the belt 85. The printed sheet dried in the drier 2 is placed on the timing belt 74, and is then delivered into the frame 5, by turning the belt 74. When the dried sheets are continuously fed one after the other on the pallet 27 of the frame 5, the edges of these sheets are guided by the inner surfaces of the sheet guides 34 and 35 to the pallet 27. The sheets are stacked at the predetermined position with their edges straightened.

In other words, when the sheets are conveyed from the drier 2 to the pallet 27, the photoelectric sensor 42 detects the leading edge of the sheet. As a result, the CPU 48 activates the air cylinder 48 to cause the sheet guide plate 45 to shift into the waiting position from the position where the edges of the sheets are straightened. At the position where the sheet guides 34 and 35 guide the sheets and stop, the CPU 48 causes the sheet guide plate 45 to return to the waiting position for straightening the edges of the sheets, from the guiding position, based on the predetermined time. As a result, the discharged sheets are pushed toward the sheet guide 35, and are stacked at the predetermined position. The sheet guide plate 45 reciprocates between the waiting position and the position where the edges of the sheets are straightened every time when the discharged sheets are stacked on the pallet 27. Therefore, the discharged sheets from the drier 2 are straightened and stacked at the predetermined position.

When the upper limit sensor 36 detects the uppermost surface of the stacked sheets which are stacked to the predetermined height, the CPU 48 drives the lift motor 10 to rotate in the forward direction. As a result, the driven sprocket wheel 15, driven shaft 14 and first lifting sprocket 17 are caused to rotate, via the drive sprocket wheel 12 and chain 16. The rotational movement of the first lifting sprocket 17 causes the second lifting sprocket 20 to rotate via the inner lifting chain 21, and the third lifting sprocket 24 to rotate via the outer lifting chain 25. Therefore, the pallet 27 is caused to shift downward by a predetermined amount. Continuously, the sheets are stacked on the pallet 27, the sensor 36 redetects the uppermost surface of the stacked sheets. Consequently, the pallet 27 is caused to shift further down by a predetermined amount.

The pallet 27 is lowered step by step, and finally activates the microswitch 29 when the pallet 27 engages with the bottom portion of the lift bar 26. As a result, the CPU 48 orders the lift motor 10, air cylinder 43, transfer motor 51 and feed motor 52 to stop. The CPU 48 transmits the control signals to corresponding controllers la and **2*a* of the printing machine 1 and the drier 2, in order to cause them to stop. The CPU 48 activates the warning buzzer 46 and the warning lamp 47 in order to inform the operator that the stacking sheets operation is completed. Therefore, the operator removes the predetermined amount of the stacked sheets from the pallet 27. After removing the stacked sheets, the operator activates the switch (not shown). Response to the switch activation, the CPU 48 causes the lift motor 10 to rotate in the reverse direction. As a result, the pallet 27** is lifted to the initial position where the printing operation has started, so that the printing operation can be resumed.

When the pallet 27 is shifted downwardly, the guides 38 of the sheet guide plate 45, the sheet guides 34 and 35 are caused to rotate around the corresponding pins 39, and to shift downwardly. Therefore, even when the uppermost surface of the stacked sheets is lowered below the bottom surfaces of the sheet guide plate 45, the sheet guides 34 and 35, the guiding operation for the discharged sheets which are further stacked on the upper most surface of the stacked sheets in the range of the predetermined height is securely accomplished by the guides 38.

According to the stacker apparatus of the present embodiment, there are following advantages that can be achieved.

(1) The stacker S includes the first transfer apparatus 3, second transfer apparatus 4 and pallet 27 integrally. The first transfer apparatus 3 can be down-sized compared to the conventional apparatus which has the separate conveyors and the stacker. Therefore, the space between the screen process printing machine 1 and the wicket drier 2 can be reduced, so that the installation space for the entire printing machine system can be reduced.

(2) When the discharged sheets are stacked on the pallet 27, the discharged sheets are guided by the right and left sheet guides 34 and the rear sheet guide 35 to the predetermined position. The operation for straightening the sheets is automatically executed based on the sheet detection operation sensing by the photoelectric sensor 42. Therefore, a large quantity of the sheets can be securely straightened and properly stacked. As a result, the operator no longer needs to straighten the stacked sheets, unlike the conventional printing machine.

(3) When the upper limit of the stacked sheets is detected by the upper limiter sensor 36, the pallet 27 is automatically lowered by a predetermined amount, so that the discharged sheets can be continuously stacked on the pre-stacked sheets. Therefore, a large quantity of sheets can be stacked without the operator's assistance. When the pallet 27 and the lift bar 26 are lowered to the bottom of the frame 5, and contact the microswitch 29 to be activated, the operation of the lift motor 10, feed motor 52 and transfer motor 51 is automatically suspended in relating to the activation of the microswitch 29. Furthermore, the warning buzzer and warning lamp are activated to inform the operator that the sheet stacking operation has been completed. Therefore, there is no need to keep watching the stacking operation during the printing operation.

(4) Even when the pallet 27 is lowered beyond the bottom edges of the sheet guides 34, 35 and 45, the discharged sheets can be straightened by the guides 38.

Although only one embodiment of the present invention has been described herein, it should be apparent to those skilled in the art that the present invention may be embodied in many other specific forms without departing from the spirit or scope of the invention. Particularly, it should be understood that the following embodiments are contemplated by the present invention:

(1) According to the above mentioned embodiment, the pallet 27 is caused to shift vertically, via the lifting chains 21 and 25. As a substitute for the lift chains, a hydraulic lift can be installed at the inner bottom portion of the frame 5, for shifting the pallet 27 vertically.

(2) According to the above mentioned embodiment, the air cylinder 43 is activated every time a single sheet is stacked on the pallet 27. Alternatively, the air cylinder 43 can be activated every time a counter for counting the number of the conveyed sheets installed in the CPU 48 shows that a predetermined number of stacked sheets has been reached.

(3) According to the above mentioned embodiment, a pair of the support plates, which protrude in the front and rear directions within the frame 5, are secured to the frame 5 by means of bolts, at the lower portion of the second transfer apparatus 4. A receiving plate or fork-shaped receiving rods, for temporally receiving the discharged sheet are detachably provided on the support plate.

Further, before the discharged sheets from the drier 2 that are stacked on the pallet 27 reach the upper limit, the receiving rods and the like are arranged on the support plates. The continuously discharged sheets from the drier are received by the receiving rods. While this operation is underway, the pallet 27 and the stacked sheets on the pallet 27 are removed from the frame 5, and another empty pallet 27 is inserted into the frame 5 for its replacement. After exchanging the pallets, the receiving rods and the like are pulled out of the frame 5. The discharged sheets on the receiving rods are stacked on the empty pallet 27. The above mentioned operation permits the exchange of the stacked sheets pallet 27 with an empty pallet, without stopping the printing machine 1 and the drier 2.

(4) This present invention can be employed for films used in panel switches, and papers, as the sheets to be printed. Therefore, the present examples and embodiments are to be considered as illustrative and not restrictive and the invention is not to be limited to the details giving herein, but may be modified within the scope of the appended claims.

What is claimed is:

1. In a printing machine system including a printing machine and a drier, the printing machine printing and discharging printed material, and the drier drying the printed material, the printing machine system comprising:

a stacker apparatus disposed intermediate the printing machine and the drier, the stacker apparatus including:

a frame;

storage means secured to said frame, for storing the printed material discharged from the drier; and first transfer means secured to said frame, said first transfer means disposed on said storage means, for transferring the printed material discharged from the printing machine to said drier.

2. The printing machine system as claimed in claim 1, further comprising second transfer means, for transferring the printed material being discharged from the drier to said storage means.

3. The printing machine system as claimed in claim 1, wherein the printed material is paper.

4. The printing machine system as claimed in claim 1, wherein the first transfer means includes:

a first conveyor for conveying the printed material being discharged from said printing machine to an upper midsection of said frame;

a second conveyor for conveying the printed material being conveyed from the upper midsection of said frame to said drier; and a motor for driving said first and second conveyors.

5. The printing machine system as claimed in claim 2, wherein said second transfer means includes:

a first conveyor for conveying the printed material discharged from the drier to the vicinity of a side edge of said frame;

a second conveyor for conveying the printed material conveyed from the vicinity of the side edge of said frame to said storage means; and a motor for driving said first and second conveyors.

6. The printing machine system as claimed in claim 5, wherein at least one of said conveyors includes an adjusting mechanism for adjusting an inclination angle of said at least one conveyor.

7. The printing machine system as claimed in claim 1, wherein said storage means includes:

a pair of lift bars vertically movably disposed within said frame;

drive means for driving said lift bars vertically; and a pallet detachably disposed on said lift bars, and supporting said printed material on an upper surface of said pallet.

8. The printing machine system as claimed in claim 7, wherein said drive means includes:

a motor;

a plurality of sprocket wheels operatively connected to the motor, for transferring the rotational movement of said motor into a vertical movement of said lift bars; and a plurality of chains.

9. The printing machine system as claimed in claim 7, wherein said storage means includes:

a plurality of guides disposed within said frame, for straightening the edges of the printed materials being stacked on said pallet;

a sheet guide plate reciprocally movably disposed within said frame, for pushing the edges of the printed materials against one of said plurality of guides; and an air cylinder for causing the sheet guide plate to reciprocate.

10. The printing machine system as claimed in claim 9, wherein at least one of said plurality of guides includes sensing means which detects an upper stacking limit for the printed materials stacked on said pallet, and which transmits a predetermined signal.

11. The printing machine system as claimed in claim 7, wherein said storage means includes sensing means for detecting the distal portion of the printed material being conveyed toward said storage means, and for transmitting a predetermined signal.

12. The printing machine system as claimed in claim 7, wherein said storage means further includes switch means for transmitting a predetermined signal when said lift bars reach a lower limit within the range of vertical movement.

13. In a printing machine system including a printing machine and a drier, the printing machine printing and discharging printed material, and the drier drying the printed material, the system comprising:

a frame disposed intermediate the printing machine and the drier;

a pair of lift bars movably disposed within said frame along the vertical direction;

drive means including a motor for vertically driving said lift bars;

a pallet detachably disposed on said lift bars, for supporting the printed material on an upper surface of said pallet;

a plurality of guides disposed within said frame, for straightening the edges of the printed materials being stacked on said pallet;

a sheet guide plate reciprocally movably disposed within said frame, for pushing the edges of the printed materials against one of said plurality of guides;

an air cylinder for causing the sheet guide plate to reciprocate;

sensing means disposed on at least one of said plurality of guides, for detecting an upper stacking limit for the printed materials stacked on said pallet, and for transmitting a predetermined signal;

sensing means for detecting the distal portion of the printed material being discharged from the drier, and for transmitting a predetermined signal;

switch means for transmitting a predetermined signal as the lift bars reach a predetermined lower limit within a range of vertical movement of the lift bars;

a first conveyor for conveying the printed material being discharged from the drier to the vicinity of a side edge of said frame;

a second conveyor for conveying the printed material being conveyed to the vicinity of the side edge of said frame to said storage means;

a first motor for driving said first and second conveyors;

first means for conveying the printed material being discharged from the printing machine to an upper midsection of said frame;

second means for conveying the printed material being conveyed from the upper midsection of said frame to said drier;

a second motor for driving said first and second conveying means; and a controller for controlling the operation of said first and second motors and said air cylinder, in response to the signals from said sensing means and said switch means.

* * * * *